United States Patent [19]

Hederus

[11] 4,182,079

[45] Jan. 8, 1980

[54] CLOSURE OPERATOR

[76] Inventor: Folke Hederus, Stickudden, Tyktorpsvagen 3, S-181 31 Lidingo, Sweden

[21] Appl. No.: 858,299

[22] Filed: Dec. 7, 1977

[30] Foreign Application Priority Data

Dec. 9, 1976 [SE] Sweden ..... 7613871

[51] Int. Cl.[2] ..... E05F 11/36

[52] U.S. Cl. ..... 49/354

[58] Field of Search ..... 49/354

[56] References Cited

U.S. PATENT DOCUMENTS

| | | | |
|---|---|---|---|
| 6,748 | 9/1849 | Reed et al. | 49/354 |
| 796,673 | 8/1905 | Richardson | 49/354 |
| 802,167 | 10/1905 | Hutt | 49/354 |
| 872,682 | 12/1907 | Prescott | 49/354 |

FOREIGN PATENT DOCUMENTS

| | | | |
|---|---|---|---|
| 580953 | 7/1933 | Fed. Rep. of Germany | 49/354 |

*Primary Examiner*—Kenneth Downey
*Attorney, Agent, or Firm*—Eugene E. Renz, Jr.

[57] ABSTRACT

A device for actuating a panel member mounted to a frame member for pivoted movement about a predetermined axis comprising an elongated rod rotatable about its longitudinal axis and mounted at an angle of about 45° relative to said pivot axis. A carrier finger is rigidly connected to one end of the rod and projects at an angle of about 90° thereto. The carrier finger is engageable in a slot in the panel and is operable, upon rotation of the rod about its axis, to effect through the carrier finger and slot, rotation of the panel relative to the frame.

7 Claims, 9 Drawing Figures

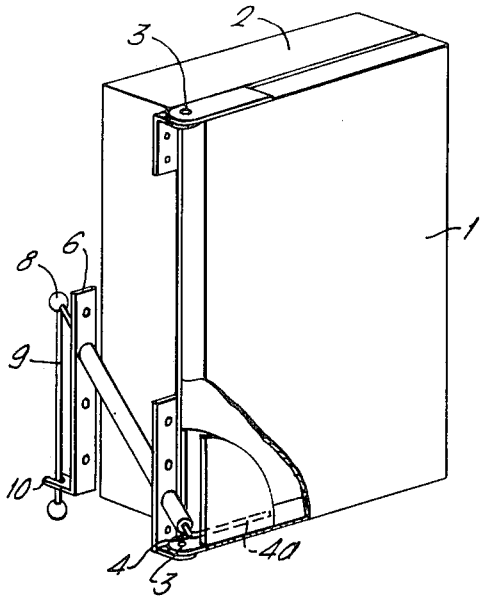
Fig. 1.
Fig. 2.
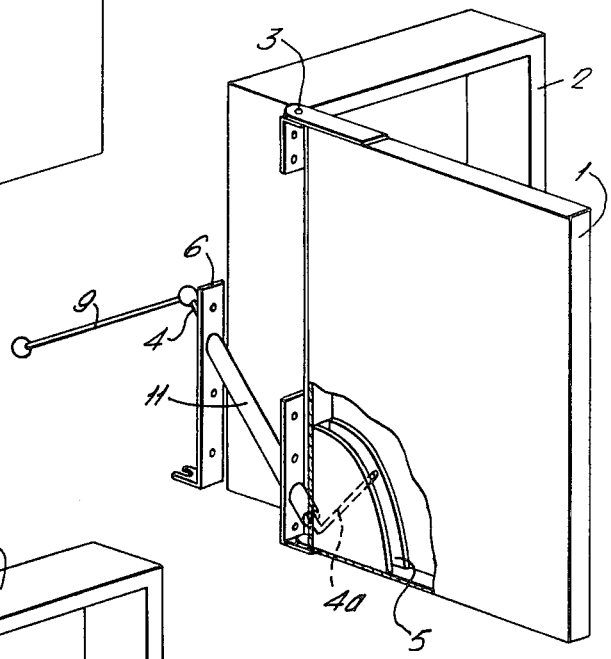
Fig. 3.
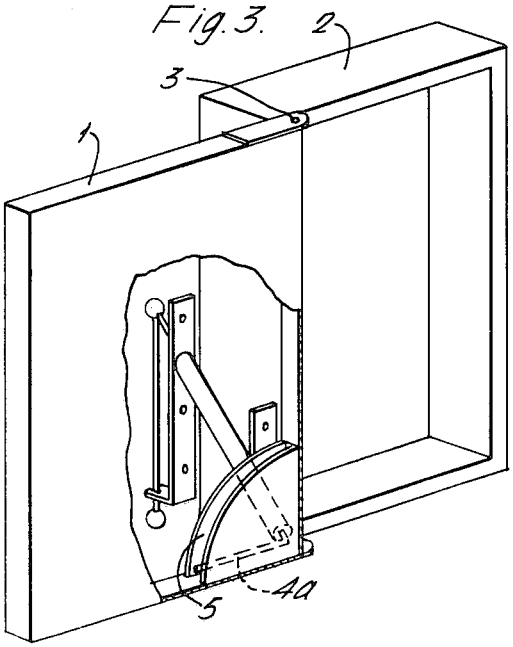

CLOSURE OPERATOR

The present invention relates to a device for operating a swivelling member, such as a window shutter, a window, a door, or the like, movable between a closed and an open position.

Previously known devices of this kind according to, for example, the French Pat. No. 2,112,154 and German Pat. Nos. 1,041,838, 890,027, 642,774 and 463,706, respectively, are either comparatively complicated or tedious to operate and handle. Some of the known mechanisms are, moreover, made in such a way that they are easily accessible from the outside. This is a drawback, when the operating device is used in connection with a window shutter, for instance, which should have the double function, when closed, of giving protection against loss of heat through the window as well as preventing intruders from gaining access through the window to an apartment or a villa. If the operating device of the shutter is accessible from without, the closed shutter constitutes no additional protection against break-ins.

The present invention has for its object to eliminate these drawbacks of previously known operating devices by creating a novel operating device of the type mentioned, which is simple to manufacture and install and can be operated quickly and comfortably and which, if desired, is inaccessible from the outside of the swivelling member, for example the shutter.

A device according to the invention which fills these requirements is characterized essentially by a rod rotatable around its own axis and forming an acute angle to the pivot axis of the member and having at one end an angularly bent carrier member which engages a guide appertaining to the swivelling member. Because the operating device consists of a simple rod with appertaining carrier member which may simply be the bent lower end of the rod itself, it is evident that the device is cheap to manufacture and easy to install. When the device is used in connection with a window shutter, a window or a door, the cord is run through the door frame or the wall, and thereby a simple operation from the inside of the wall is permitted. The guide may consist of a boring in a lower corner of the swivelling member in which the angularly bent carrier member runs while cooperating with the sides of the boring. If desired, a metal fitting having two parallel sides may be inserted in the boring to serve as guide. Alternatively, such a fitting may be applied on one side of the swivelling member.

When the guide is inside the swivelling member, e.g. the window shutter, while the rod runs through a wall or window frame in the way indicated, it is obvious that the device becomes essentially inaccessible from without.

When the rod is pivoted around its axis, the bent carrier member is swivelled causing the swivelled member to move between a closed and an open position.

If the rod is fixed in position it has reached when the swivelling member is in closed position, the angularly bent carrier member serves as a catch member holding the swivelling member in closed position, so that it cannot be opened.

It is preferable, for good operation, that the intersection between the axes of the rod and the angularly bent carrier member is situated approximately on the geometrical pivot axis of the swivelling member. Further, it is preferable that the rod runs in a plane substantially at right angles to the plane of the member in its closed position.

The rod should form an angle of about 45° to the pivot axis of the member and the angularly bent portion should form an angle of about 90° to the rod.

When rotating the rod to open the swivelling member from its closed position, the angularly bent carrier member will describe a path at the beginning of which it runs parallel to the lower edge of the swivelling member, via position in which the angularly bent carrier member forms an angle of 45° to the said lower edge—the swivelling member having been opened 90°—into a position where the swivelling member has performed a revolving movement of 180°, i.e. reached its fully open position; at this point the angularly bent carrier member again lies parallel to the lower edge of the swivelling member.

To facilitate the operation, the rod has a handle at the end opposite to the angularly bent end. This handle may have any desired shape and may consist of a knob which is turned when the swivelling member is to be opened. The operating handle should be releasably lockable, at least in the closed position of the swivelling member.

In a preferred embodiment of the invention, the operating handle consists of a rod member linked to the rod. This renders possible a quick and simple opening movement by means of lever action. Such an operating handle can be easily locked to a fitting, for instance, and thereby the swivelling member is kept correspondingly locked, e.g. in its closing position.

Further features and advantages of a device according to the invention will be apparent from the following description of some embodiments thereof. The description will refer to the attached diagrammatic drawings.

In the drawings:

FIGS. 1–3 are perspective views showng the operating device applied to a shutter hinged to a frame. FIG. 1 shows the shutter in closed position, FIG. 2 in half opened position, and FIG. 3 in fully opened position.

Figure 7:
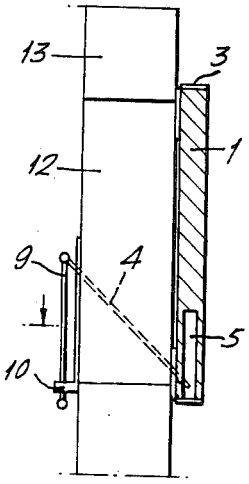
Figure 8:
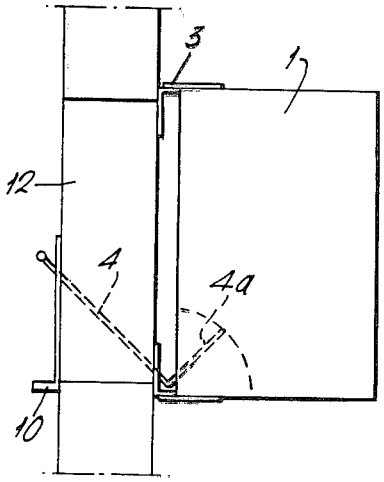
Figure 9:
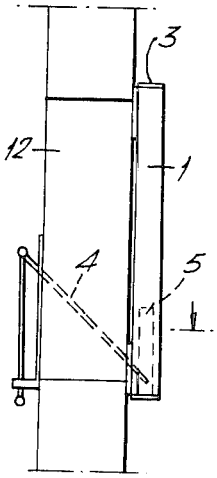

FIGS. 7–9, finally, are vertical sections through the shutter structure in corresponding positions.

In the figures, corresponding members have the same reference numerals.

1 designates a shutter, such as a window shutter hinged to a frame 2. The pivot axis of the shutter is designated by the numeral 3.

The operating device of the shutter consists of a rod 4 forming an angle of about 45° to the pivot axis of the shutter and having at its lower end an angularly bent carrier finger **4*a* engaging a fitting 5** having two parallel side walls, which is inserted in a boring in the lower left-hand corner of the shutter. The fitting may be said to have the shape of a circle sector with a center angle of 90°.

The angularly bent carrier finger **4*a* forms an angle of 90° to the rod 4. The intersection between the axes of the rod 4 and the angularly bent carrier finger 4*a* lies on the pivot axis 3** of the shutter.

The inner end of the rod 4 is connected by a link 8 to an operating handle 9 that is releasably held in a fork-shaped catch member 10 on a fitting 6 accommodating a tubular sleeve 11 in which the rod is mounted. The tubular sleeve runs through a further fitting 7 in the area of the pivot axis of the shutter.

When the operating handle 9 is engaged by the catch member 10 of the fitting 6, the shutter 1 is locked in closed position so that it cannot be opened from the outside.

To release the shutter, the operating handle 9 is released from the catch member 10 and turned counter-clockwise so that the carrier finger 4*a* is swivelled upwards as shown in FIG. 2. Thereby the shutter is opened. In FIG. 2, the operating handle 9 is shown pivoted through 180° in relation to the position that the handle holds when turned counter-clockwise as described above. If it is desired to fix the shutter in the position shown in FIG. 2, this can be done in a simple manner by means of a suitable catch means on the fitting 6. If, however, it is desired to open the shutter fully, i.e. to the position shown in FIG. 3, the operating handle is pivoted downwards through 90° and again locked in the catch member 10. Thereby the shutter is kept locked in the position reached.

Figure 4:
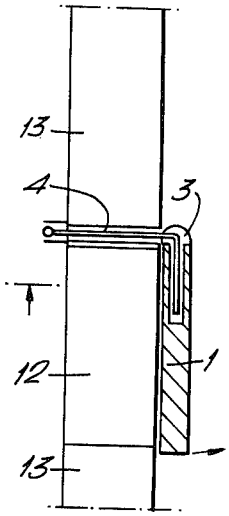
FIGS. 4–6 are horizontal sections through the shutter structure in corresponding positions.
Figure 5:
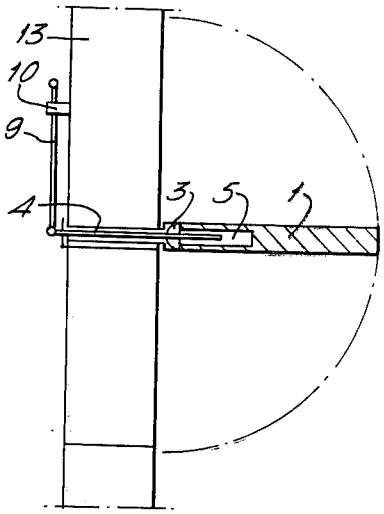
Figure 6:
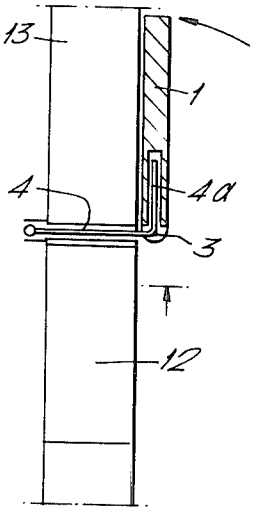

FIGS. 4–6 are horizontal section illustrating the corresponding steps when opening a shutter swivelling in the opposite direction from fully closed into fully opened position. It is apparent from these figures that the pivot axis of the shutter coincides with the intersection between the axis of the rod 4 and the angularly bent carrier finger 4*a*. Further, FIG. 5 shows a catch member 10 for the rod by means of which the shutter 1 is held locked after an opening movement of 90°.

In this embodiment, the shutter 1 can be said to consist of a window shutter closing an opening 12 in a wall 13. The rod 4 is inserted through the wall 13, and the entire operating device is essentially inaccessible from the outside.

FIGS. 7–9 are vertical sections of the shutter arrangement in FIGS. 4–6.

A satisfactory operation is possible also if the rod 4 forms another angle than 45° to the pivot axis 3 and/or the carrier finger 4*a* forms another angle than 90° to the rod 4. The fitting 5 need not be formed as a circle sector with a center angle of 90°, as the carrier finger 4*a* will only move within an area corresponding to a center angle of about 45°. Consequently, it is sufficient with a correspondingly designed boring or fitting. However, a fitting of the type shown can be expected to facilitate the manufacture and mounting thereof.

Also other modifications are possible within the scope of the inventive idea as it appears from the attached claims.

I claim:

1. A device for actuating a panel member mounted to a frame member for pivotal movement about a predetermined axis, comprising an elongated rod rotatable about its longitudinal axis and mounted at an acute angle relative to said pivot axis, a carrier finger rigidly connected to one end of said rod and projecting at an appropriate angle thereto, the longitudinal axis of said rod and the longitudinal axis of said carrier finger intersecting at approximately said predetermined axis,; same line, adjacent said predetermined axis has been inserted after "slot" means defining a guide slot in said panel, said carrier finger engageable in said slot and operable, upon rotation of said rod about its axis to effect through said carrier finger and slot, rotation of said panel relative to said frame about said pivot axis.

2. A device as claimed in claim 1 wherein said rod is disposed in a plane substantially at right angles to the plane of said panel member when in closed position and forming an angle of 45° said predetermined axis.

3. A device as claimed in claim 2 wherein said carrier finger forms an angle of approximately 90° to said rod.

4. A device as claimed in claim 3, wherein said rod has an operating handle at the end remote from the carrier finger.

5. A device as claimed in claim 4, wherein said operating handle can be releasably locked at least in the closed position of said panel member.

6. A device as claimed in claim 5, wherein said operating handle comprises a rod member linked to said rod.

7. A device as claimed in claim 1, wherein said rod is mounted in a bearing sleeve.

* * * * *

UNITED STATES PATENT AND TRADEMARK OFFICE

CERTIFICATE OF CORRECTION

PATENT NO. : 4,182,079

DATED : January 8, 1980

INVENTOR(S) : Folke Hederus

It is certified that error appears in the above-identified patent and that said Letters Patent are hereby corrected as shown below:

Claim 1, lines 17-19; delete ";"same line, adjacent said predetermined axis has been inserted after "slot""

Claim 1, line 19; insert after "slot" —adjacent said predetermined axis—

Signed and Sealed this

*Sixth* Day of *May 1980*

[SEAL]

*Attest:*

SIDNEY A. DIAMOND

*Attesting Officer*

*Commissioner of Patents and Trademarks*